United States Patent [19]

Wilson

[11] Patent Number: 4,493,110

[45] Date of Patent: Jan. 8, 1985

[54] BAG CONSTRUCTION

[75] Inventor: James R. Wilson, Northport, N.Y.

[73] Assignee: Equitable Bag Co., Inc., Long Island City, N.Y.

[21] Appl. No.: 433,540

[22] Filed: Oct. 8, 1982

Related U.S. Application Data

[62] Division of Ser. No. 182,799, Aug. 29, 1980, Pat. No. 4,362,526.

[51] Int. Cl.[3] ..... B65D 33/06; B65D 33/24

[52] U.S. Cl. ..... 383/27; 383/87

[58] Field of Search ..... 150/7, 12; 229/54 R, 229/62, 54 C; 383/27, 86, 87

[56] References Cited

U.S. PATENT DOCUMENTS

| | | | |
|---|---|---|---|
| 1,065,450 | 6/1913 | Klein | 150/7 |
| 3,155,134 | 11/1964 | Buono | 150/7 |
| 3,339,822 | 9/1967 | Pearl | 150/12 |
| 3,525,468 | 8/1970 | Kamins et al. | 229/54 R |
| 3,782,622 | 1/1974 | Montgomery | 229/54 R |
| 3,836,068 | 9/1974 | Schwarzkopf et al. | 229/54 R |
| 3,837,564 | 9/1974 | Marquardt et al. | 229/54 R |
| 3,960,314 | 6/1976 | Faiers | 150/7 |
| 3,966,524 | 6/1976 | Lehmacher | 229/54 R |
| 4,102,487 | 7/1978 | Soto | 150/7 |

FOREIGN PATENT DOCUMENTS

| | | | |
|---|---|---|---|
| 1334831 | 10/1973 | United Kingdom | 229/62 |
| 2074985 | 6/1980 | United Kingdom | 229/62 |

*Primary Examiner*—Stephen P. Garbe

*Attorney, Agent, or Firm*—Hopgood, Calimafde, Kalil, Blaustein & Judlowe

[57] ABSTRACT

This invention is a novel plastic bag and method of making it with a handle that extends upward through a folded-back top compartment, and the end of a front of the bag has a pocket with a similar folded-over top edge of the back of the bag. The bags of this invention are made from a continuous sheet, preferably a roll of plastic web that has its opposite side edges folded inwardly along opposite edges of the web to make the folded edges at the front and back sides of the bag. The web is then folded along its longitudinal center region with a gusset that forms the bottom of each bag. The bags have surfaces that are welded together to join areas of the front and of the back where necessary to weld plastic areas together, and certain areas do not weld where the plastic sheet is coated on areas that prevent heat applied to the plastic from fusing together.

2 Claims, 6 Drawing Figures

2
34
10
10a
32
28
38
36
30
42
42
40
12
18
26
26
24
18
22
44
16
44
10a
2

34
32
28
36
38
30
42
18
24
20
26
46
10
22
12
14
16

34
32
22
36
38
30
20
42
24
10
12
14
16

22
34
24
32
20
36
38
30
12
14

34'
70
36'
70
42
-30'-
38'
-30'-
44'
42
44'

10'
10'
76
70
30
70'
70'
68
66
22
24
16
22
44
32
50
52
52
26'
30
36
24
62
60

BAG CONSTRUCTION

RELATED CASE

This application is a division of my copending application Ser. No. 182,799, filed Aug. 29, 1980, now U.S. Pat. No. 4,362,526 issued Dec. 7, 1982.

BACKGROUND AND SUMMARY OF THE INVENTION

Finished plastic packages are formed from sheet plastic material such as polyethylene or polyvinyl chloride. The sheet plastic is unrolled in a flat area with opposite longitudinal edges folded to form cuffs along that eventually form the top edges of the front and back panels of the bag. Edges of the bags are cut from successive bags along sides of the bags and where no connection is to be made, the web is coated with material that prevents the plastic from adjacent layers from fusing to one another.

The bags are made by folding a roll of plastic sheeting on a center line that runs longitudinally of the plastic roll as it is unrolled, and the plastic is folded along its longitudinal center line so that the fold is at the center of the bottom of each bag; and the material on opposite sides of the longitudinal center line becomes the front and back of the successive bags that are formed by severing the bags upon melting through the plastic to provide bags with welded edges at the sides of the bags. The folded longitudinal edges that are bent to form the cuffs along opposite edges of the roll of plastic provide upside-down pockets with slots at the upper fold lines and handles extending through the slots and having their opposite sides secured to the stiff handles that are longer than the slots and lift the bags by contact with the top folds, beyond the ends of the slots. The construction has a handle at the top of the front or back of the bag and a similar pocket at the top of the front or back that does not have a handle. A similar pocket that does not have the handle, does have a pocket with a slot that telescopes over the pocket with the handle to hold the bag closed by putting the handle through the slot in the pocket that has not handle to close the top of the bag as a neat package.

The sides of the bag are welded together by applying heat that welds the front and back panels where the bags are melted along lines of severance. In order to locate the pocket that has no handle in a convenient location for telescoping over the pocket that does have the handle, when closing the bag, surfaces of the bags that would weld together by the heat that cuts the individual bags apart has heat resistant lacquer applied to surfaces which are not to be welded to one another in the final assembly of the bag.

Other objects, features and advantages of the invention will appear or be pointed out as the description proceeds.

BRIEF DESCRIPTION OF DRAWING

In the drawing forming a part hereof, where corresponding parts are indicated by the same reference characters in all the views.

DESCRIPTION OF PREFERRED EMBODIMENT

Figure 1:
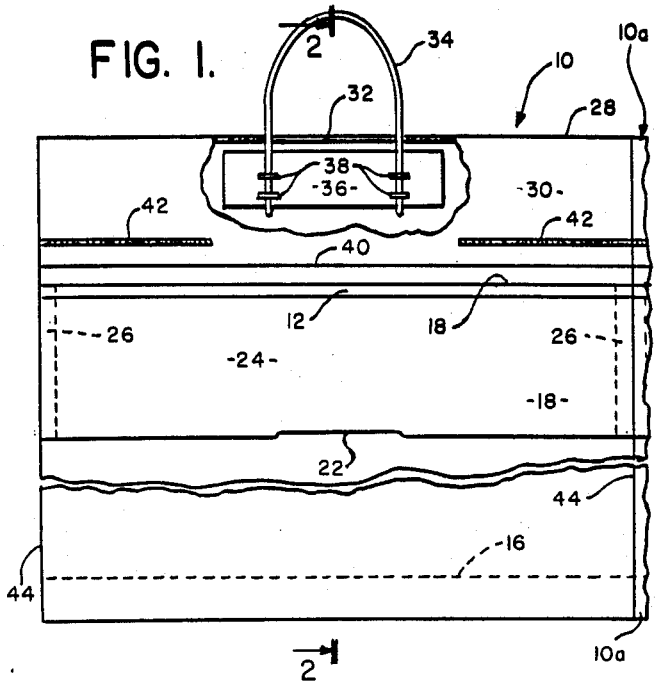
FIG. 1 is a fragmentary view of connected bags of this invention before being cut from one another at a station where successive bags have not yet been severed.

The bags 10 of this invention are preferably made of plastic such as high-density polyethylene, preferably of gauge thickness approximately 0.0015 to 0.0025. The advantage of high-density polyethylene is that it is stiffer than low-density and is more like stiff paper, whereas the low-density polyethylene is floppy and less popular with customers who use the bags of this invention for a popular type of shopping bag. The outstanding advantage of plastic as compared with paper is that the plastic bags can be made by economical processes which permit individual welded bags to be made from large rolls of plastic webbing. The structure of an individual bag will be explained in connection with FIGS. 1 and 2, and the process for making it will be explained in connection with FIG. 4.

In the preferred construction, each bag 10 (FIG. 2) is made with a back sidewall 12 and a front sidewall 14 connected together at their lower ends by a gusset fold 16.

The upper portion of the front sidewall 14 is folded downward along a horizontal fold or hinge alignment 18 to form a rearward panel 20 which then folds forward and upward at a fold line 22 to provide a front panel 24.

The confronting faces between the fold 18 and the fold 22 are coated with a layer of lacquer 26 shown as a heavy line between panel 20 and the unfolded adjacent portion of panel 14 (i.e., to the vertical extent between fold lines 18 and 22) so that the panels coated with the lacquer 26 cannot become welded to one another during the final heating of the plastic material from which the bag is made, namely, when the bags are locally melted (a) to separate them from one another and (b) to seal the involved vertical edges of the bags when melted from one another along the alignment of their vertical edges.

The back sidewall 12 extends all the way to the top 28 where it folds over and extends downwardly. The top fold 28 has a slot 32 through which a handle 34 extends. The handle 34 is preferably made of a flexible tube or cord and is secured to a panel 36 by staples 38. The panel 36 is longer than the slot 32 so that both ends of the panel bear against the fold 28 beyond both ends of the slot 32.

The pocket 30 extends downward to its lower edge 40, and the top fold 28 is closed at both of its horizontal ends by welding of the panels of the bag (i.e., by vertical edge welds on alignments 44) and by additional welds 42 which connect the front of the pocket 30 to the back panel 12 to form the top pocket into a closed compartment except for the slot 32 and the space below the slot 32 through which the handle 34 and panel 36 can be inserted or removed from the bag.

When the bag is completed and severed along a line from the continuous line of similar bags, as will be explained in connection with FIG. 4, the finished bag is severed from the next bag 10a (FIG. 1) by fusing the plastic along the entire length of the line 44. The front panel 24 and the rearward panel 20 are pulled loose from the front sidewall 14 by swinging the panels 24 and 20 about hinge 18, as indicated by the arrow 46 in FIG. 2; and a slot 22' at the fold line 22 between panels 20 and 24 can be swung into the position shown in FIG. 3 and then pulled downward, thereby enabling the front panels 20 and 24 to be moved to telescope with the pocket 30 and complete the closing of the bag. Space between the rearward sidewall 12 and the front sidewall 14 can be expanded to accommodate the articles placed in the bag by having the gusset 16 open up at its fold, thereby increasing the space within the bag.

Figure 4:
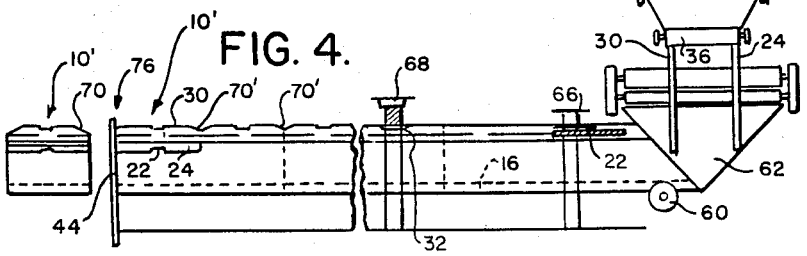
FIG. 4 is a diagrammatic showing, on a greatly reduced scale, showing the successive steps of the method of making the bags of this invention.

FIG. 4 shows diagrammatically the method by which the bag of this invention is produced. A roll 50 of plastic from which the bags are to be made is carried by supports 52. An applicator 26' is located in position to apply a non-fusable lacquer 26 to the surface of the outside convolution of the roll of plastic 50, at a location suitably positionable to apply the lacquer indicated by the reference character 26 in FIGS. 1 and 2. A folding tool 56 folds opposite edges of the roll 59 to form cuffs along both sides. These cuffs are indicated by the reference characters 24 and 30, in FIGS. 1, 2 and 4 of the drawings.

Figure 2:
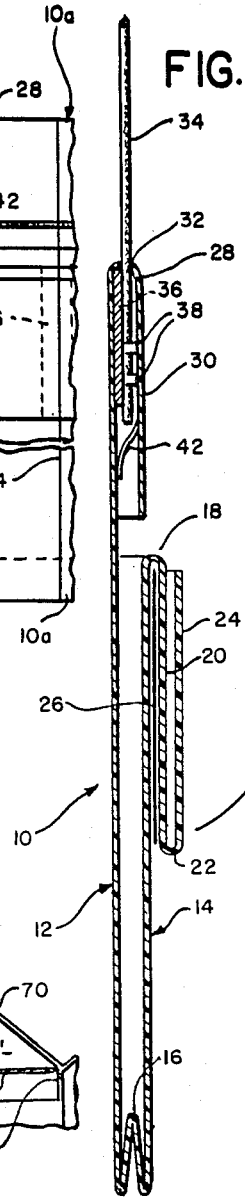
FIG. 2 is a greatly enlarged sectional view taken on the line 2—2 of FIG. 1.

A roller 60 near the apex of a former 62 folds the web 50 along its longitudinal center line to provide the gusset 16 (FIGS. 1, 2 and 4).

Figure 3:
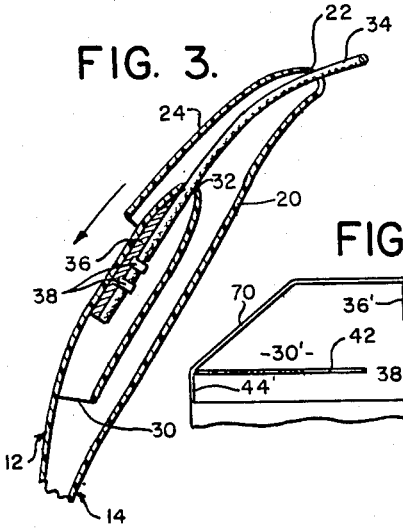
FIG. 3 shows the way in which the rearward top pocket has a handle which flexes forward, and the front pocket (right hand in FIG. 2) is telescoped over the rearward pocket and the handle, when the bag has been cut apart from the other bags and filled and closed.

Cutters 66 and 68 cut the openings 22 and 32, handles 34 being later assembled and always extending through the slots 32, and being adapted for later insertion and pulling through the slots 22, as shown in FIG. 3.

Successive bags 10 are cut from the connected line of bags at a cutting station 76 where heat is applied for the full height of the end bag along a line of severance 44. This cutting operation is applied along the line 44 of FIG. 1, and the line of bags is cut along the line 44 through all layers of the plastic. This cutting operation fuses the plastic on opposite sides of the line 44, except for the area 26 where lacquer was applied to prevent the lacquer-covered surfaces from welding together, as explained in connection with FIGS. 2 and 3. In consequence, the lower front pocket is formed between panels 20 and, 24, but no pocket is formed between front sidewall 14 and the pocket panel 20, the confronting faces of these panels 14–20 having been lacquer-insulated and, therefore, not heat-bonded or at least so weakly heat-bonded as to be readily openable, upon outward swinging movement of the lower front pocket, as suggested by the arrow 46, to perform the operation.

Figure 2A:
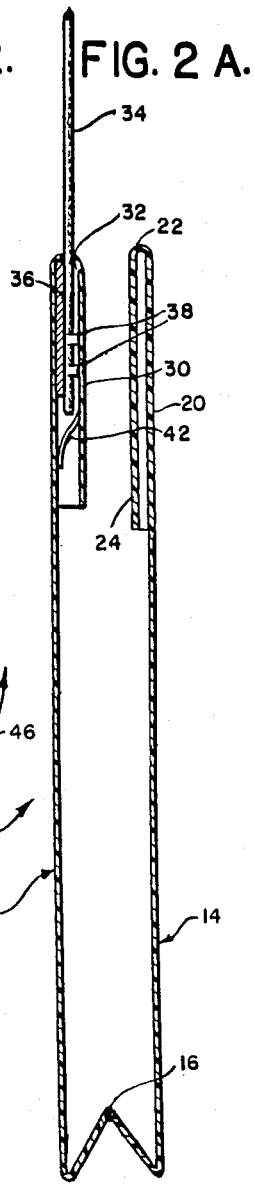
FIG. 2A is a view similar to FIG. 2, to show the bag of FIGS. 1 and 2 after the front flap thereof has been folded up.

In FIG. 2A, corresponding parts will be recognized from FIG. 2 and have therefore been identified by the same reference numbers. The only difference is that in FIG. 2A, the pocket of the front panel 14 is not folded forward as in FIG. 2 but rather is downwardly and inwardly folded (from the upper end 22 of the front panel 14), and this front-panel pocket is downwardly open, in general conformance with and in adjacent relation to the downwardly open pocket of the rear panel 12. Operation to telescopically fit this front-panel pocket over the rear-panel pocket (and handle) is as described for FIG. 2.

Figure 5:
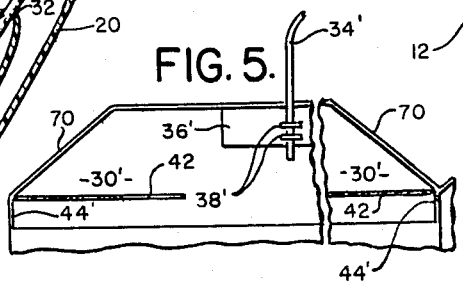
FIG. 5 is a modified construction.

FIG. 1 shows the vertical edges of the bag 10 extending parallel to one another for the full height of the bag. However, in the modification of FIG. 5, the bag blanks have edges at opposite ends of a top panel 30' which slope so that what was the pocket 30 of FIG. 1 is in FIG. 5 trimmed off on side-edge sloping alignments 70 at both sides of the double layer defining the front and back panels of the pocket 30', the side edges 70 being fused together along their sloping edges. The welds 42 of FIG. 5 are the same as in the construction of FIG. 1, and in FIG. 4, wide-angle V-cuts 70', by local fusing at bag-width intervals, are shown to account for the sloping side edges 70 in the severed bag 10'. The cut off corners 70 will be understood to make it more convenient to pull the front pocket 20–24 over the top pocket 30'.

What is claimed is:

1. A plastic bag having front and rear panels connected by a horizontal bottom end and welded to one another along vertical edges extending upwardly from said bottom end to a location offset from the upper end of said rear panel, the rear panel having its upper end folded forward along a horizontal fold line and edge-welded to itself to form a top pocket that is substantially closed at its upper end and open along its bottom end, a handle extending through an opening in the closed upper end of the top pocket, a front pocket downwardly folded along a horizontal hinge line which is adjacent to the open bottom end of the top pocket, the front pocket comprising front-panel upper-end material folded forward against itself along a horizontal fold line at a location below said hinge line, the folded front-panel upper-end material being edge-welded to itself to define the front pocket closed on three sides and upwardly open along a horizontal alignment near said hinge line, the fold line of the front pocket being below the hinge line to substantially the same extent as the hinge line is below the closed upper end of the top pocket, whereby the front pocket can be upwardly swung to accept telescoping insertion of the top pocket, and an opening in the fold line of the front pocket through which the handle extends when the front pocket is telescoped over the top pocket.

2. A plastic bag formed from a single sheet of flexible plastic material and having front and rear panels connected by a horizontal bottom end, said front and rear panels being vertically substantially coextensive between upper ends and said bottom end and being welded to each other along vertical edges, the welding extending upwardly from said bottom end to an upper elevation which is offset from the upper ends of said panels, whereby a bag pocket is defined by and between the bottom and welded edges of said panels, the upper ends of the respective panels being characterized by folded upper-end panel material which has been folded inwardly and downwardly against itself along fold lines, said fold lines forming the upper ends of the front and rear panels, said folded material being in each case edge-welded to itself and defining an inner pocket which extends downwardly to, and is downwardly open at, an elevation proximate to the upper elevation of the welded vertical edges of said bag pocket, the fold lines of the respective upper ends being at substantially the same elevation, a handle retained in the rear-panel pocket and extending through a local opening in the fold line thereof, whereby the front-panel pocket may be manipulated by telescopically inserting the fold edge of the rear-panel pocket into said front-panel pocket, and a corresponding opening in the fold line of the front-panel pocket for through-accommodation of said handle when the bag is closed.

* * * * *